United States Patent [19]

Beall

[11] 4,416,370

[45] Nov. 22, 1983

[54] COMPARTMENTED CONTAINER

[76] Inventor: Robert Beall, 11 Heather La., Columbia, Mo. 65201

[21] Appl. No.: 411,452

[22] Filed: Aug. 25, 1982

[51] Int. Cl.[3] ..... B65D 85/00; B65D 77/40; B65D 3/24

[52] U.S. Cl. ..... 206/217; 206/222; 206/634; 206/19; 215/6; 220/22; 229/1.5 B

[58] Field of Search ..... 206/217, 222, 19, 634; 215/6; 229/1.5 B; 220/22

[56] References Cited

U.S. PATENT DOCUMENTS

| | | | |
|---|---|---|---|
| 1,798,339 | 3/1931 | Soulis | 206/217 |
| 2,328,872 | 9/1943 | Yealdhall et al. | 206/217 |
| 3,010,598 | 11/1961 | Foss | 206/222 |
| 3,451,540 | 6/1969 | Kulischenko | 206/222 |
| 3,514,029 | 5/1970 | Powell | 206/19 |
| 3,920,120 | 11/1975 | Shueda | 206/217 |

*Primary Examiner*—William T. Dixson, Jr.
*Attorney, Agent, or Firm*—Haverstock, Garrett & Roberts

[57] ABSTRACT

A compartmented container suited for use in conjunction with administering the sacramental elements during a communion service and for taking medication and like substances comprising a body member having first and second ends and a side wall portion extending therebetween, a central opening extending through the body member, a floor disposed at an intermediate location along the side wall portion and extending across the central opening separating the body member into first and second compartments, the first compartment being substantially cup-like in form to hold a liquid therein, a closed wall member extending from the floor member into the second compartment forming a cavity therewithin for receiving and storing a communion wafer, a pill or tablet, or other non-liquid substance therein, the closed wall member being spaced inwardly from the side wall portion of the body member forming a space therebetween, and a separate closure member slidably receivable within the second compartment including a closed wall member shaped to be movable in the space formed between the side wall portion of the body member and the closed wall member forming the cavity, the closure member having a rupturable membrane extending thereacross adjacent one end thereof and being positionable within the second compartment such that the membrane extends across and closes the cavity, the closure member being movable in the second compartment against the cavity forming wall member whereby the cavity forming wall member ruptures the membrane and provides access to the non-liquid substance stored within the cavity.

17 Claims, 4 Drawing Figures

COMPARTMENTED CONTAINER

This invention relates to a simple compartmented container conveniently adaptable for holding and dispensing the sacramental elements of bread and wine in a quick, orderly fashion to an individual or to members of a congregation during a communion service and, more particularly, to an improved closure mechanism for retaining and dispensing the bread element or any other substance from the lower compartment of the subject device. The novelty of the present invention resides primarily in the opening and closing means associated with the lower compartment and in this regard the subject device is an improvement over the container construction disclosed in Applicant's U.S. Pat. No. 4,324,338. The subject device is also conveniently adaptable for use in the dispensing and taking of medications and other substances.

A wide variety of containers are known and have been employed for a multitude of uses including the holding and dispensing of the sacramental elements of bread and wine during a religious communion service. The known prior art devices also teach a variety of container constructions adapted for use in storing and dispensing a multitude of other liquid and solid substances therefrom. See for examples the constructions shown in U.S. Pat. Nos. 4,078,686; 4,051,977; 4,033,453; 3,541,029; 2,611,499; 1,798,339; 1,082,710; and in Canadian Pat. No. 1,031,738. As explained in Applicant's U.S. Pat. No. 4,324,338, the known constructions for the most part are characterized by complicated and cumbersome container constructions which consist of multiple component parts, are relatively large, awkward and difficult to hold and operate, and require a considerable amount of dexterity in the handling of the substances contained therein, be it bread and wine or some other substances. These disadvantages considerably extend the overall time involved in administering the sacramental elements especially to a large congregation. In addition, most of the known devices require intricate and cumbersome means for accessing and dispensing the substances contained therein thereby substantially increasing their complexity in requiring added parts as well as additional time, care, and agility in dispensing various substances therefrom. Although the container construction disclosed in Applicant's U.S. Pat. No. 4,324,338 greatly improves the capability of effectively and expeditiously storing and dispensing substances therefrom, it has been found that the opening and closing of the pivotal closure member associated therewith may present problems for some individuals such as the weak, elderly, and the infirm, who, due to infirmities and impairments which affect muscular control and dexterity, find it difficult, if not impossible, to adequately manipulate the pivotal closure member to gain access to the substances stored within the lower compartment. Such persons often also drop the communion wafer or other substance contained within the lower compartment and this may cause some disruption as during a communion service. In addition, dropping of the substance stored within the lower compartment may also render the substance unsanitary and therefore unusable. It is therefore desirable to provide a relatively more simple container conveniently adaptable for holding and dispensing both a liquid and a non-liquid substance therefrom which at the same time can be easily manipulated by all persons including those individuals having infirmities or impairments which reduce their muscular control and manual dexterity.

The present device solves many of the aforementioned problems and overcomes many of the disadvantages and shortcomings associated with known container devices, and teaches the construction and operation of a relatively simple container device which is also relatively inexpensive to make, compact, convenient and includes easily operable means for expeditiously accessing and dispensing the substances contained therein. The improved means utilized in the present device for dispensing the substances contained within the lower compartment is particularly advantageous for the elderly and others who may have difficulty removing such substances from the lower compartment. The present device is especially advantageous for use in religious services where the bread and wine elements are dispensed to the communicants during the communion service, and its use considerably decreases the time required for distributing the sacramental elements, especially where it is necessary to distribute such element or other substances to a relatively large group. The present device may also be utilized for dispensing medications and other substances, and the device lends itself to being filled or partially filled in an automatic process.

The present device is comprised of a body member having first and second end portions and a closed side wall portion extending therebetween defining a central opening therethrough. A floor member extending transversely across the central opening at an intermediate location along the closed side wall portion separates the body member into compartments on opposite sides thereof. The floor member and the closed side wall portion extending upwardly therefrom define a first cup-like compartment extending to one end of the body member which is generally cylindrical or tapered in shape and is adaptable to hold a liquid therein. The cup-like compartment preferably has its upper end portion flared outwardly so as to aid users in drinking from it. The floor member and the closed side wall portion extending downwardly therefrom define a second compartment located below the cup-like compartment. Annular or other shaped closed wall means preferably integrally formed with the floor member extends downwardly therefrom into the second or lower compartment forming a storage cavity within the lower compartment adaptable for receiving a communion wafer, a pill, a tablet, or some other like substance. A separate movable closure member in the form of a hollow cylinder is slidably receivable within the lower compartment and includes a rupturable membrane extending across the upper end thereof, which membrane is preferably made from a relatively thin flexible material yet adaptable to hold and support a communion wafer or like substance positioned in the storage cavity thereabove. The closure member is positionable within the lower compartment such that the rupturable membrane closes and forms the bottom wall portion of the storage cavity located therewithin. The size and shape of the cavity forming wall means controls and determines the amount of usable storage space within the lower compartment. When so positioned, the closure member extends at least partially beyond the bottom end portion of the lower compartment such that when upward pressure is exerted thereagainst, such as by using the palm of one's hand or by pushing the device down on a relatively hard surface, the closure member moves upwardly within the lower compartment and the flexible membrane engages the cavity forming wall located therewithin thereby rupturing said membrane and allowing the communion wafer or other substance positioned thereon and within the cavity to fall out and be dispensed therefrom. This provides a simple expeditious means for dispensing the contents of the lower compartment, which means requires no mechanical manipulation of parts by the user. In addition, the flexible membrane may likewise be perforated, serrated, or otherwise scored to further facilitate rupturing. Additionally, the subject device may also include means for holding the rupturable membrane in position to close and seal the storage cavity within the second compartment.

The present device is preferably constructed of a durable material, preferably transparent, such as a plastic material or impact-resistant glass able to withstand moderate impact and normal usage. It is also anticipated that the separate closure member may be constructed of a less rigid material such as a relatively thin flexible plastic and the rupturable membrane associated therewith may be either integrally molded with the closure member or it may be separately attached thereto by gluing or by other suitable means. In addition, the present device can be made so as to be either totally disposable or it can be constructed for repeated use, if desired. Although it is anticipated that the present device will be used primarily in association with the administering of the sacramental elements during religious ceremonies, it can likewise be conveniently adapted for other uses such as dispensing medication to patients in hospitals or other similar institutions.

It is therefore a principal object of the present invention to provide an improved compartmented container capable of being used to efficiently and expeditiously dispense both a liquid and a non-liquid substance therefrom.

Another object is to provide a compartmented container which is convenient and easy to handle and use and reduces the overall time required for dispensing the sacramental elements or other substances therefrom.

Another object is to provide a compartmented container which can be easily manipulated by persons who may have infirmities or impairments which affect their muscular control and dexterity.

Another object is to provide a compartmented container having improved means for easily accessing and dispensing substances contained within its lower compartment.

Another object is to provide an improved compartmented container which can be made so as to be either disposable or constructed for repeated use.

Another object is to provide an improved compartmented container which is simple structurally and operationally, compact, and convenient and advantageous for use even with relatively large numbers of people.

Another object is to provide an improved compartmented container which is easily and conveniently adaptable for dispensing medication including pills or tablets in association with a liquid.

Another object is to provide a relatively simple trouble free container which has few moving parts and can be operated by users of all ages and abilities.

Another object is to provide an improved compartmented container which may be quickly and easily prepared and refilled for succeeding use.

Another object is to provide a compact compartmented container which can be easily and conveniently carried, transported, and stored when not being used.

Another object is to make it easy to gain access to a product in an enclosed space.

These and other objects and advantages of the present invention will become apparent to those skilled in the art after considering the following detailed specification in conjunction with the accompanying drawings, wherein.

Figure 1:
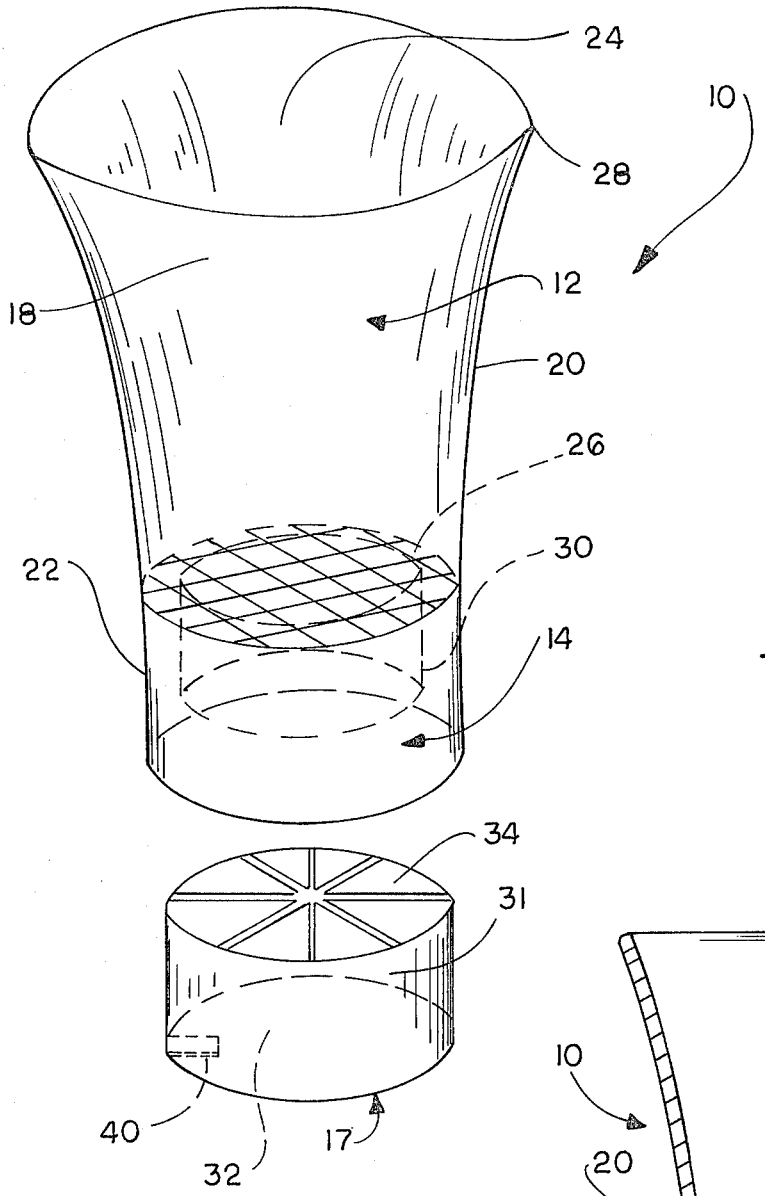
FIG. 1 is an enlarged exploded perspective view of a compartmented container constructed according to the teachings of the present invention.
Figure 2:
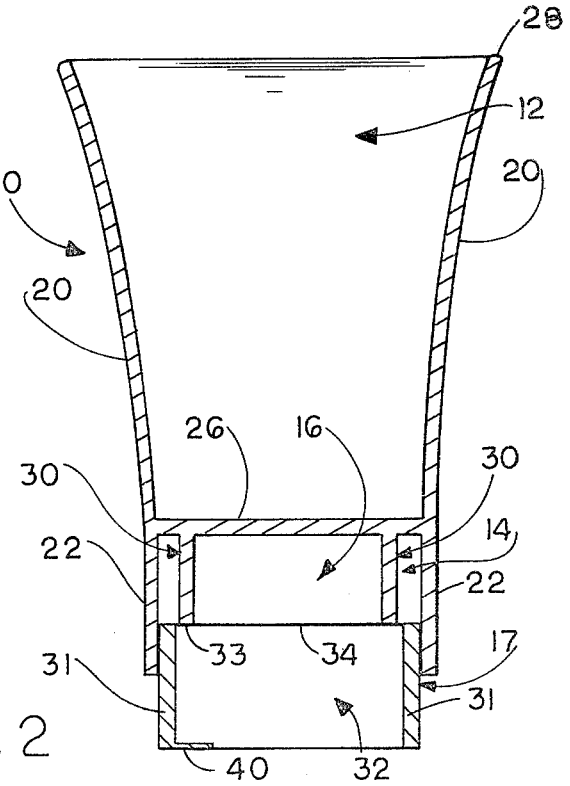
FIG. 2 is a cross-sectional view taken through the center of the compartmented container of FIG. 1 showing the closure member associated with the lower compartment in position closing the storage cavity formed within said compartment.

Referring to the drawings more particularly by reference numbers wherein like numerals refer to like parts, number 10 in FIG. 1 refers to a compartmented container constructed according to the present invention. The container 10 includes a cup-like or liquid holding compartment 12, a lower compartment 14 having a storage cavity 16 therewithin for receiving and storing non-liquid substances, and a closure member 17 for positioning within the lower compartment 14 and movable therein to gain access to the storage cavity 16 as will be described. The container 10 includes a closed side wall member 18 which is shown as being annular and has an opening 24 extending therethrough, and a floor member 26 disposed between the ends thereof at an intermediate location. The floor member 26 separates the container into the segregated compartments 12 and 14. The closed side wall member 18 has a cup forming portion 20 thereof extending upwardly from the floor member 26 to form the side wall of the liquid holding compartment 12 and another portion 22 that extends in the opposite or downward direction from the floor 26 to form the side wall of the lower compartment 14. The position of the floor member 26 can be varied somewhat depending upon the size and volume desired for each of the respective compartments 12 and 14. In addition, the upper side wall portion 20 may be tapered somewhat to facilitate handling and holding and the upper end portion of the wall portion 20 may be flared outwardly as at 28 for ease of drinking therefrom. The lower compartment 14 is preferably integrally formed with the cup-like compartment 12.

The floor member 26 has a closed wall member 30 extending downwardly therefrom part way through the lower compartment 14 as shown in FIGS. 1–4. The wall 30 is shown as being annular (FIG. 1) and is preferably integrally formed with the floor member 26, although any suitable means for connecting the same such as by gluing may be utilized. The wall 30 and the floor 26 define the cavity 16 for receiving and storing a communion wafer, a pill, a tablet, or some other like substance therein as will be hereinafter explained.

Figure 3:
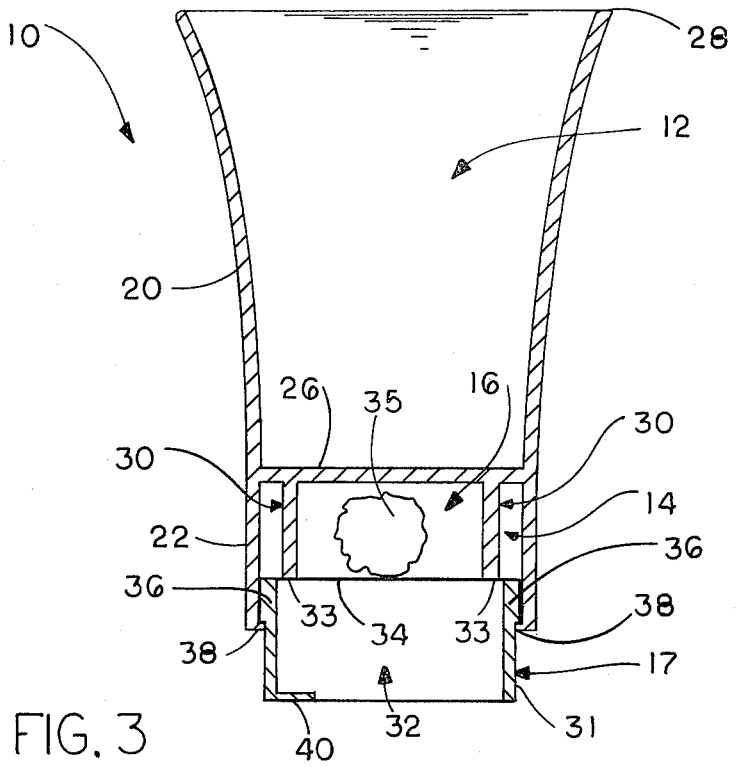
FIG. 3 is a cross-sectional view similar to FIG. 2 but showing optional means for holding the closure member in position to close the storage cavity.
Figure 4:
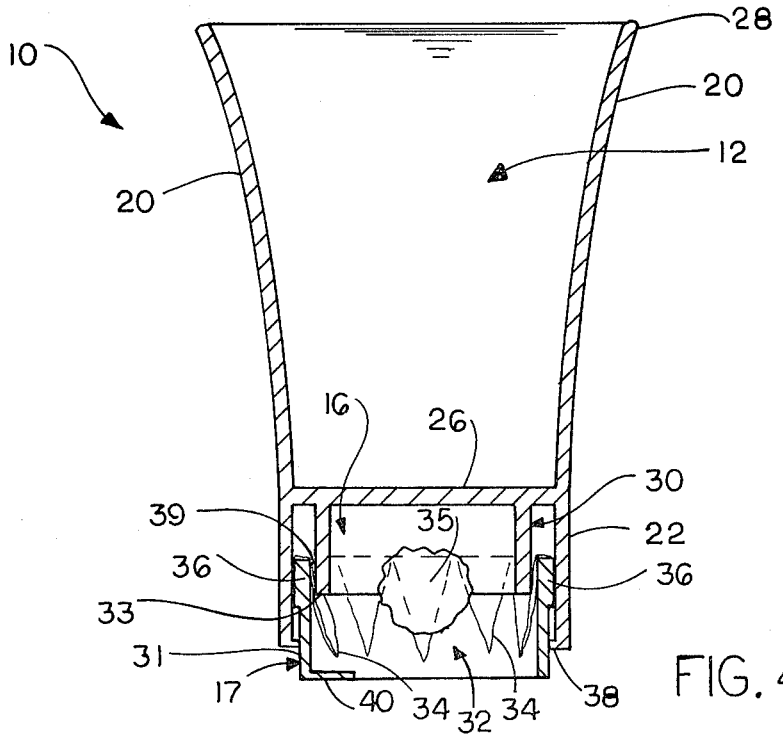
FIG. 4 is a cross-sectional view similar to FIG. 3 showing the flexible membrane associated with the closure member being ruptured during movement of the closure member upwardly into the lower compartment.

Access to the storage cavity 16 is controlled by the closure member 17 which is slidably receivable within the lower compartment 14 as shown in FIGS. 3 and 4. The closure member 17 is shown as being cylindrical in shape to slidably and frictionally cooperate with the inner surface of the lower wall portion 22 that surrounds the lower compartment 14. The closure 17 also includes an annular closed side wall portion 31 defining a space 32 extending therethrough. A relatively thin rupturable membrane 34 extends across one end of the space 32 at one end of the closure 17 as shown in FIG. 1. When the member 17 is positioned within the lower compartment 14 it is moved to a position so that the membrane 34 engages the lower end 33 of the cavity wall 30 and thereby forms the bottom closure wall for the storage cavity 16. In this position the membrane 34 also supports the communion wafer or other products positioned in the cavity 16. The membrane 34 is preferably formed of a relatively thin flexible material such as a plastic, cellophane, nylon, paper or some other relatively thin sheet-like material, but it must be sufficiently strong to be able to support the particular substance positioned in the cavity 16. It is also important that the material selected for the membrane 34 be sanitary and non-toxic so as not to contaminate the substance positioned thereon. The membrane 34 may be integrally formed with the closure member 17 as aforesaid or it may be separately attached thereto such as by gluing, sonically welding, or by other suitable joinder means.

Once the communion wafer or other non-liquid substance such as substance 35 (FIGS. 3 and 4) is positioned within the storage cavity 16, usually while holding the device upside down, the closure member 17 is slidably positioned within the compartment 14 to a position such that the flexible membrane 34 abuts the lower end 33 of the wall 30 (FIG. 3) thereby closing the space in the cavity 16. When so positioned, the substance 35 rests upon and is supported by the membrane 34 as shown in FIG. 3. The side wall portion 31 of the closure member 17 should preferably be frictionally engaged at this time with the inner surface of the wall 22 of the lower compartment 14 so that when the device is overturned the closure member 17 will not fall out but will remain in place and continue to support the wafer or other product 35 in the cavity 16. The floor 26, the wall 30, and the membrane 34 together define the storage are of the cavity 16, and the size and shape of the wall 30 can be varied somewhat depending upon the size and volume of the storage space desired. The size and shape of the closure member 17 in comparison to the size and shape of the lower compartment 14 will control and determine the frictional engagement between the walls 22 and 31. The side wall 31 may also optionally include a sidewardly extending offset such as portion 36 (FIGS. 3 and 4) positioned to cooperate with an optional corresponding projection 38 (FIGS. 3 and 4) formed on the lower edge of the wall portion 22 to locate and hold the membrane 34 in position closing the cavity 16. The projection 38 need not extend completely around the lower edge of the wall portion 22 but should be positioned and arranged such that the optional offset portion or stop 36 on the closure member 17 may be easily placed in registration therewith to provide adequate support for the member 17 when in its closed position.

When positioned within the lower compartment 14 to close and seal the cavity 16, the closure member 17 extends at least partially beyond the lower end portion of the compartment 14 as shown in FIG. 3. Dispensing of the communion wafer or any other substance contained within the cavity 16 is achieved by simply pushing or pressing the member 17 upwardly into the compartment 14. A slight upward pressure exerted against the lower portion of the member 17, such as by using the palm of one's hand or by pushing the device 10 downwardly on a relatively hard surface, is usually sufficient to move the member 17 upwardly within the compartment 14 between the side wall 22 and the annular wall 30 as shown in FIG. 4. As the member 17 is forced upwardly within the compartment 14, the flexible membrane 34 engages the lower edge 33 of the wall 30 and the upward movement causes the flexible membrane 34 to rupture and fold downwardly into the space 39 formed between the side wall portion 31 of the member 17 and the wall 30 as shown in FIG. 4. The space 39 should be of sufficient width to receive the bent over portions of the ruptured membrane 34 during movement of the member 17 upwardly within the lower compartment 14. Once the membrane 34 ruptures, the communion wafer or other substance 35 positioned thereon is able to freely pass through the space 32 formed by the ruptured membrane 34 in the member 17, which space should be of sufficient size and shape to allow the substance 35 stored within the cavity 16 to easily pass therethrough. The flexible membrane 34 may also be perforated, serrated, or otherwise scored as shown in FIG. 1 to further facilitate and to control the rupturing thereof. In addition, a serrated or knife edge may be formed on the terminal end portion 33 of the wall 30 to further facilitate rupturing of the membrane 34.

This easy and convenient means for dispensing the contents of the lower compartment requires no mechanical manipulation of parts by the user and is especially important for those individuals who may have difficulty if the dispensing operation is too complicated, especially individuals having physical handicaps and/or other deficiencies or impairments affecting their motor activities. In addition, the lower portion 22 of the side wall member 18 is preferably cylindrical in shape and not tapered, and the size and shape of the cavity 16 should be such as to correspond substantially with and able to receive a conventional communion wafer or like substance. Although the storage cavity 16 is shown as being cylindrical in shape, it is also recognized that the cavity 16 may be conveniently fashioned into a variety of sizes and configurations, for example, it may have a triangular, rectangular, square, elliptical, hexagonal, or other configuration suitable to accommodate the particular item or substance to be dispensed therefrom. Similarly, the size and shape of the closure member 17 may likewise be varied to correspond to the size and shape of both the lower compartment 14 and/or the cavity 16.

Inasmuch as the present device 10 is compact and does not require intricate and cumbersome means for storing, accessing, and dispensing elements therefrom, it is ideally suited for use in conjunction with the administering of the sacramental elements during a communion service. Furthermore, because of its simplicity both structurally and operationally, the present device greatly facilitates such administration and considerably reduces the overall time required for dispensing the contents even when used by a relatively large congregation. To receive the sacramental elements or otherwise dispense substances from the present container 10, a user simply pushes the closure member 17 upwardly into the lower compartment 14 thereby rupturing the flexible membrane 34 and dispensing the communion wafer or bread element from the cavity 16 and thereafter drinks the wine contained in the liquid holding compartment 12. This relatively simple method of dispensing both the bread and wine elements from a single container is important to the present invention because it not only improves the overall efficiency of dispensing the sacramental elements but likewise enables all communicants regardless of age, health, and manual dexterity to quickly and easily participate in and partake of the communion service. Although it is anticipated that the present device will be used primarily in association with the administration and distribution of the sacramental elements during a religious ceremony, it should be noted that the present device has many other possible applications and uses including being easily and conveniently adaptable for storing and dispensing other items such as medication, especially when a pill or tablet is to be taken with water or some other liquid. For example, a quantity of medicaments in pill or tablet form can be conveniently stored in the non-liquid holding cavity 16 and may be dispensed therefrom and consumed along with a liquid contained within the liquid holding compartment 12. Typical of such uses are uses by anyone who takes medicine with a liquid such as the chronically ill who take medication to control an illness. Additionally, the present device is particularly adaptable for dispensing medication in hospitals or other similar institutions where a predetermined dosage level of a particular type of prescribed medication may be stored in the lower holding compartment and may be distributed to the patient with the upper compartment containing a fluid which may be water or some fluid that itself contains medication. In this situation, use of the present device allows the person preparing the subject device to control dispensation of prescribed medication to individual patients.

Although it is recognized that various materials of construction are available, it is preferred that the present device 10 be constructed of some durable impervious material, preferably transparent, such as certain plastic materials which are able to withstand some abuse during normal usage and are both readily available and inexpensive. A relatively hard plastic or impact-resistant glass could likewise be utilized. It is also anticipated that the closure member 17 may be constructed of a less rigid material as compared to the remainder of the container 10 such as of a relatively flexible plastic or other material which is likewise readily available and inexpensive. In addition, the present device 10 can be made so as to be either disposable or it can be constructed for repeated use if desired, and, depending on which is preferred, this may control what material is used in the construction of the device.

If the device 10 is constructed for repeated use, only the closure member 17 need be discarded and replaced after each usage. Once the contents of the compartments 12 and 16 are dispensed therefrom, a user can easily and conveniently refill the device 10 by simply removing the member 17 and thereafter inverting the container 10 and positioning the communion wafer or other substance within the storage cavity 16. A new closure member 17 may then be slidably positioned within the compartment 14 as previously explained. The liquid holding compartment 12 may thereafter be refilled and the subject device is again ready for use. The member 17 may include a tab 40 extending sidewardly from the side wall thereof as shown in FIGS. 1, 3, and 4 to facilitate gripping and removal of the member 17 from within the compartment 14 after each usage. The construction of the present device 10 also lends itself to being easily cleaned and prepared for succeeding use and it can be conveniently carried, transported, or stored in a relatively small space although it is also contemplated to make the subject device in larger sizes as well especially where more liquid is to be consumed as with certain medications. The ease of handling, storing, and transporting further increases the flexibility, versatility, and usefulness of the subject deivde. Where it is anticipated that the present device will only be used once and then discarded, the entire device can be conveniently constructed from a relatively inexpensive material so as to be totally disposable after initial usage. In either case, it is to be noted that the present device 10 is relatively easy to make using known molding and extrusion techniques and known plastics or other substances.

Similarly, devices made from plastic or certain other materials may likewise have color and/or artistic designs incorporated into or on such materials for enhancing the beauty and aesthetic qualities of the devices. In addition, it is recognized that the side wall portions of the present device may likewise be conveniently fashioned into a variety of sizes and configurations without departing from the teachings and practice of the present invention. The simplicity, durability, flexibility, and versatility of the present device greatly increases its usefulness and effectiveness for expeditiously administering the sacramental elements during a communion service as well as for a wide variety of other uses and applications as stated.

Thus there has been shown and described a novel compartmented container conveniently adapted for use in administering the sacramental elements of bread and wine during a communion service and for taking medication and like substances, which container fulfills all of the objects and advantages sought therefor. Many changes, modifications, variations and other uses and applications of the present device will, however, become apparent to those skilled in the art after considering this specification and the accompanying drawings. All such changes, modifications, variations and other uses and applications which do not depart from the spirit and scope of the invention are deemed to be covered by the invention which is limited only by the claims which follow.

What is claimed is:

1. A compartmented container adaptable for holding a liquid and a non-liquid substance therein comprising a body member having a first substantially cup-like portion for holding the liquid substance therein and a second portion defining a second compartment for holding the non-liquid substance therein, said body member having first and second ends and a closed side wall portion extending therebetween, a floor member disposed at an intermediate location along the closed side wall portion separating the cup-like portion from said second compartment, a closed wall member extending from said floor member into said second compartment forming a cavity therewithin adaptable to receive the non-liquid substance therein, said closed wall member being positioned in spaced relation inwardly from the closed side wall portion of said body member to form a space therebetween, a closure member slidably receivable within said second compartment including a closed wall member shaped to be movable in the space between the closed side wall portion of said body member and the closed wall member forming said cavity, said closure member having a rupturable membrane extending thereacross adjacent one end thereof whereby said membrane can be moved against the cavity forming wall member to rupture said membrane and provide access to the non-liquid substance stored in said cavity.

2. The compartmented container defined in claim 1 wherein the first end of said body member is flared outwardly to facilitate drinking therefrom.

3. The compartmented container defined in claim 1 wherein the portion of said closed side wall portion that defines said cup-like compartment is tapered from end-to-end.

4. The compartmented container defined in claim 1 wherein said rupturable membrane is made from a relatively thin flexible material.

5. A compartmented container for holding a liquid and a non-liquid substance therein comprising a tubular body member having first and second end portions and a side wall portion extending therebetween defining a central opening therethrough, a floor member extending transversely across said central opening at an intermediate location along said side wall portion to separate the central opening into compartments on opposite sides thereof, said floor member and said side wall portion defining a first substantially cup-shaped compartment extending to one end of the tubular body member for holding a liquid therein and a second compartment extending to the opposite end of said tubular body member for holding a non-liquid substance therein, wall means extending from said floor member into said second compartment forming a cavity therein for receiving and storing the non-liquid substance, said cavity forming wall mean being spaced inwardly from said side wall portion to form a space therebetween, a separate closure member including a closed wall member shaped to be movable in the space between the cavity forming wall means and said side wall portion, said closure member having a rupturable membrane extending thereacross adjacent one end thereof and being slidably movable within said second compartment from a first position wherein said membrane is positioned adjacent to said cavity forming wall means to close said cavity and a second position wherein said membrane engages and is ruptured by said cavity forming wall means to provide access to the non-liquid substance stored within said cavity.

6. The compartmented container defined in claim 5 wherein the second end of said side wall portion and said closure member have means associated therewith that are cooperatively engagable when said closure member is in its first position to maintain said closure member in said first position.

7. The compartmented container defined in claim 6 wherein said means for maintaining said closure member in its first position includes an offset portion formed on the closed wall of said closure member and a projection formed on the second end of said side wall portion, said projection being in a position to be able to engage said offset portion when the closure member is in said first position.

8. The compartmented container defined in claims 1 or 5 wherein said membrane has perforations associated therewith to facilitate the rupturing thereof.

9. The compartmented container defined in claims 1 or 5 wherein said closure member has a tab portion extending sidewardly therefrom to facilitate gripping said closure member during removal thereof from the second compartment.

10. A container dispensing device having a cup portion for holding a liquid substance and a second compartment portion for holding a non-liquid substance comprising a container body member having first and second compartments formed therein, said container body including a tube-like member having first and second ends and a side wall portion extending therebetween with a central opening extending through said container body, a floor member disposed at an intermediate location between the first and second ends of said side wall portion across said central opening separating said container body into said first and second compartments, said first compartment being adaptable to receive and hold a liquid therein, said second compartment being adaptable to hold a non-liquid substance therein, a closed wall member extending from the floor member into said second compartment in spaced relation inwardly from the side wall portion of said container body to form a space therebetween, said closed wall member and said floor member defining a cavity within said second compartment adaptable to receive and store the non-liquid substance therewithin, a closure member slidably receivable within said second compartment including a wall member having an opening extending therethrough and a flexible membrane extending across said opening adjacent one end thereof, the wall member associated with said closure member being shaped to be movable in the space formed between the side wall portion of said container body and the closed wall member forming said cavity, said closure member being movable into said second compartment to a first position wherein said flexible membrane extends across and in contact with the closed wall member to form a closure wall for said cavity, said closure member being movable to a second position whereby the closed wall member ruptures said membrane and provides access to the non-liquid substance stored within said cavity, said non-liquid substance being dispensed through the opening extending through said closure member when said membrane is ruptured.

11. The container dispensing device defined in claim 10 wherein the portion of said side wall portion defining said first compartment is tapered from end-to-end.

12. The container dispensing device defined in claim 10 wherein said container body, said closed wall member and the wall member associated with the closure member are all annular in shape.

13. The container dispensing device defined in claim 10 wherein the closed wall member has a serrated edge portion for engaging and rupturing the membrane.

14. A container dispensing device having a cup portion for holding a liquid substance and a second compartment portion for holding a non-liquid substance comprising a container body member having first and second compartments formed therein, said container body including a tube-like member having first and second ends and a side wall portion extending therebetween with a central opening extending through said container body, a floor member disposed at an intermediate location between the first and second ends of said side wall portion across said central opening separating said container body into said first and second compartments, said first compartment being adaptable to receive and hold a liquid therein, annular wall means extending from said floor member into said second compartment forming a cavity therein adaptable to receive and store a non-liquid substance therein, said annular wall means being spaced inwardly from the side wall portion of said container body to form a space therebetween, a closure member slidably receivable within said second compartment including an annular wall member shaped to be movable in the space formed by and between the side wall portion of said container body and said cavity forming wall means, said closure member having a rupturable membrane extending thereacross adjacent one end thereof in position to be moved in one position thereof against said cavity forming wall means to close the cavity and in another position whereby the cavity forming wall means ruptures said membrane and provides access to the non-liquid substance stored within said cavity.

15. The container dispensing device defined in claim 14 including means on said closure member and on said container body to hold said membrane in the one position closing the cavity.

16. The container dispensing device defined in claim 14 wherein the portion of said side wall defining said first compartment is tapered from end-to-end.

17. The container dispensing device defined in claim 14 wherein the portion of said side wall forming the second compartment, said annular cavity forming wall means and the annular wall member of said closure member are cylindrical in shape.

* * * * *

UNITED STATES PATENT OFFICE

CERTIFICATE OF CORRECTION

Patent No. 4,416,370 Dated November 22, 1983

Inventor(s) Robert Beall

It is certified that error appears in the above-identified patent and that said Letters Patent are hereby corrected as shown below:

Column 5, line 42 "are" should be --area--.

Column 8, line 8 "deivde" should be --device--.

Column 9, line 31 "mean" should be --means--.

Signed and Sealed this

*Fourteenth* Day of *February 1984*

[SEAL]

*Attest:*

GERALD J. MOSSINGHOFF

*Attesting Officer*

*Commissioner of Patents and Trademarks*